US006648602B2

(12) United States Patent
Horng et al.

(10) Patent No.: US 6,648,602 B2
(45) Date of Patent: Nov. 18, 2003

(54) FAN HAVING BALANCING BLADE SETS

(75) Inventors: Alex Horng, Kaohsiung (TW); Ching-Shen Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 13 days.

(21) Appl. No.: 10/026,643

(22) Filed: Dec. 27, 2001

(65) Prior Publication Data

US 2003/0123975 A1 Jul. 3, 2003

(51) Int. Cl.[7] ..... F04D 29/38
(52) U.S. Cl. ..... 416/203; 416/237
(58) Field of Search ..... 415/175, 177, 415/178, 204, 208.3, 211.1, 211.2; 416/183, 175, 203, 185, 237; 361/687, 688

(56) References Cited

U.S. PATENT DOCUMENTS

| | | | | |
|---|---|---|---|---|
| 3,904,308 A | | 9/1975 | Ribaud | 415/143 |
| 4,502,837 A | | 3/1985 | Blair et al. | 415/198.1 |
| 4,901,920 A | * | 2/1990 | Wollin | 239/2.2 |
| 6,179,561 B1 | | 1/2001 | Horng | 415/208.3 |

* cited by examiner

*Primary Examiner*—Edward K. Look
*Assistant Examiner*—Dwayne J. White
(74) *Attorney, Agent, or Firm*—Bacon & Thomas, PLLC

(57) ABSTRACT

A fan having balancing blade sets is disclosed herein comprising a central hub, a shaft and a plurality of blade sets. The blade sets are radially extended from an outer circumference of the central hub and each blade set is uniformly formed within an appropriate angular length to ensure stable rotation. Each blade set is comprised of various blade designs to enhance blowing efficiency.

5 Claims, 6 Drawing Sheets

FAN HAVING BALANCING BLADE SETS

BACKGROUND OF THE INVENTION

1. Field of the Invention

The present invention is related to a fan having balancing blade sets for balanced rotation, and more particularly to a fan having a plurality of blade sets in balance with relation to an axis of the fan to ensure stable rotation.

2. Description of the Related Art

A variety of fan blade designs have been employed in cooling electronic devices such as CPUs, and in similar heat exchanger applications. In various applications, fan blades are designed to move airflow through adjacent heat exchangers, a heat sink for example, or through air channels. Balance of rotation is an important consideration in fan operation and high balance level is also a requirement. Therefore, a need exists for improved construction of the fan.

Referring initially to FIG. 1, an axial flow fan 9 consists of a central hub 90, a plurality of fan blades 91 extending radially outward from an outer circumference 92 and a shaft 93 axially extending from the central hub 90. It moves simply and axially airflow by means of rotating blades 91.

Referring to FIG. 2, U.S. Pat. No. 6,179,561 discloses a fan 8 comprising a central hub 80, a plurality of axial blades 81, a plurality of blower blades 82 and a shaft 84. The blades 81 and 82 are extended radially outward from an outer circumference 83 of the central hub 80 and are directly concerned with movement of air. Functionally, the blades 81 and 82 move airflow axially and radially in synchronization while the fan 8 is rotating. Furthermore, the axial blades 81 and blower blades 82 are separated into two stacking layers on the outer circumference 83, one layer for axial blowing and the other layer for radial blowing. However, the recent trend in fan blades has been to incorporate various blade designs into a common layer for both enhancing airflow's efficiency and reducing the entire thickness of the fan. Meanwhile, balance of rotation when incorporating various blade designs is still an important consideration.

Other fans are designated various blade designs on different layers, see for example U.S. Pat. Nos. 3,904,308 and 4,502,837.

The present invention is intended to provide a plurality of blade sets arranged in balance, each set comprising various blade designs and formed within an appropriately angular length for balanced rotation in such a way as to mitigate and overcome the above problem.

SUMMARY OF THE INVENTION

The primary objective of this invention is to provide a fan having balancing blade sets to rotate in balance and ensure stable rotation.

The secondary objective of this invention is to provide a fan having balancing blade sets which comprise various blade designs that enhance blowing efficiency.

The present invention is a fan having balancing blade sets. The fan having balancing blade sets mainly comprises a central hub, a shaft and a plurality of blade sets. The blade sets are radially extended from an outer circumference of the central hub and each blade set is uniformly formed within an appropriate angular length to ensure stable rotation. Each blade set is comprised of various blade designs to enhance blowing efficiency.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
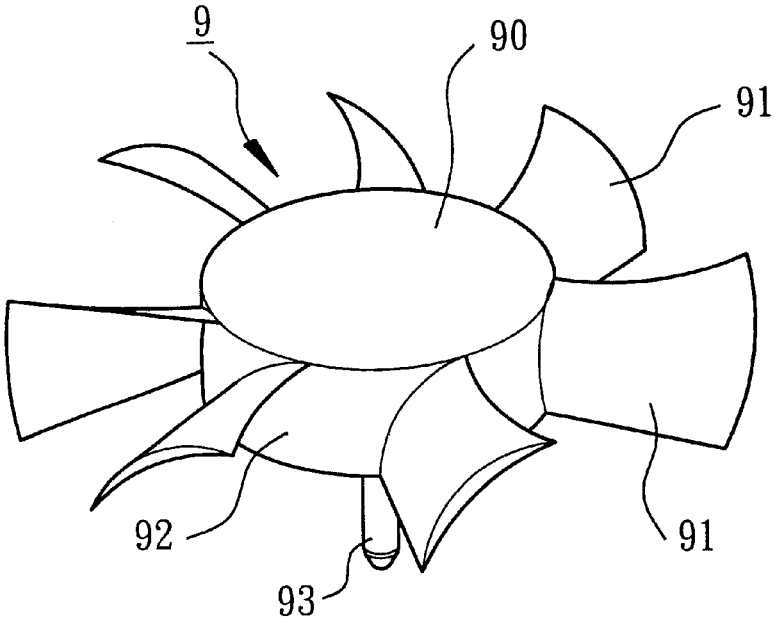
FIG. 1 PRIOR ART
FIG. 1 is a perspective view of a conventional fan.
Figure 2:
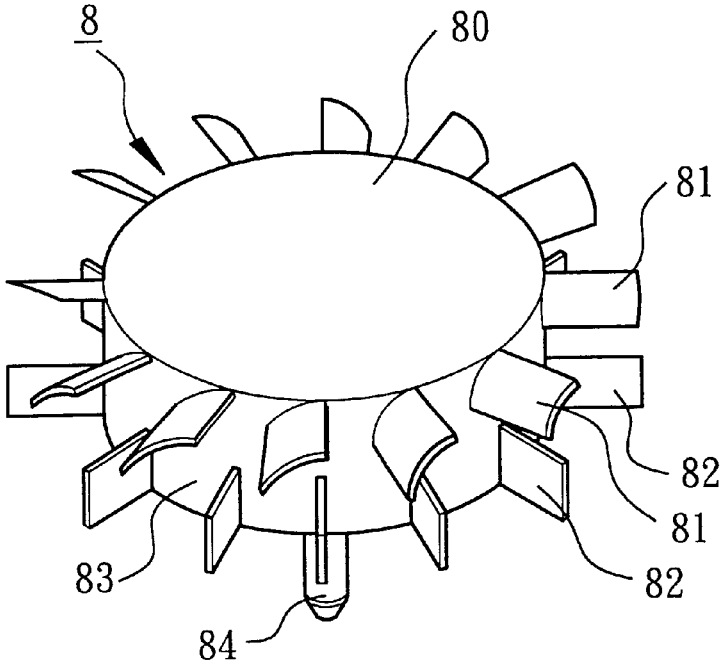
FIG. 2 PRIOR ART
FIG. 2 is a perspective view of another conventional fan.
Figure 3:
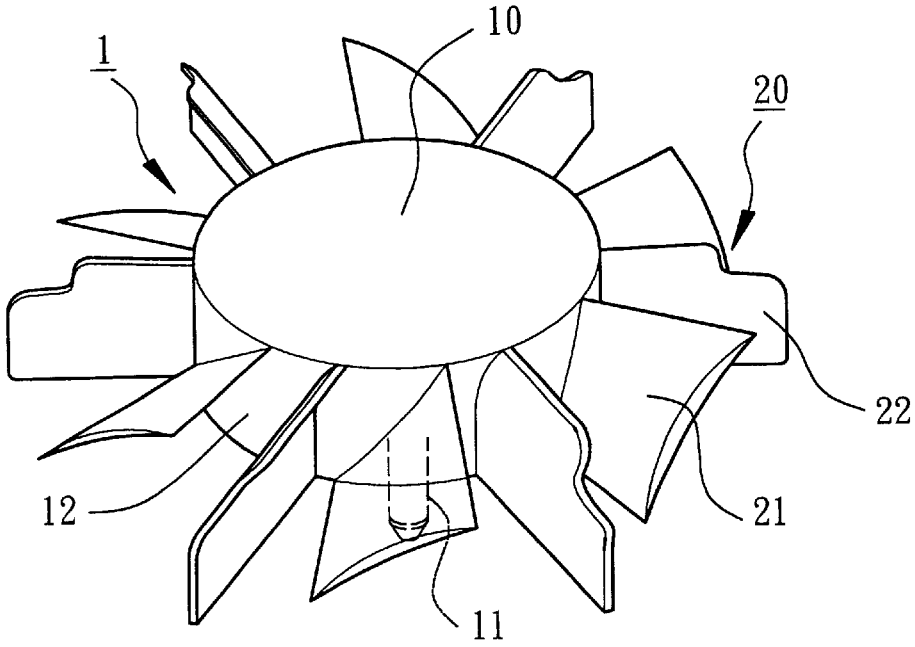
FIG. 3 is a perspective view of a fan in accordance with a first embodiment of the present invention.

Referring now to the drawings, there are three embodiments of the present invention shown therein, all of which include generally a primary fan member and a secondary fan housing member.

Figure 4:
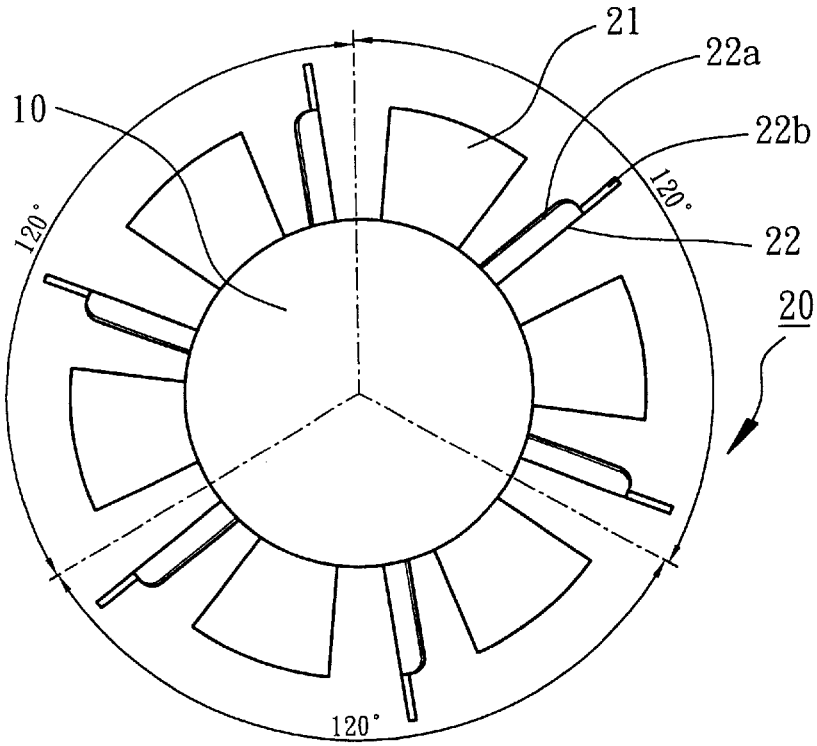
FIG. 4 is a top view of the fan in accordance with the first embodiment of the present invention.

Referring initially to FIGS. 3 through 7, a fan designated as numeral 1 having balancing blade sets in accordance with the first embodiment of the present invention generally includes a central hub designated as numeral 10, a shaft designated as numeral 11 and a plurality of blade sets designated as numeral 20. The shaft 11 is axially extended from the central hub 10 to be rotatably received in a bearing (not shown) to rotate as a rotor of a motor. The preferred amount of the blade sets 20 is three and the sets are arranged to circle around an axis of the central hub 10 on a common plane. The blade sets 20 are equi-spaced and radially extended from an outer circumference 12 of the central hub 10 and each blade set 20 is uniformly formed within an angular length 120°, in dotted line, to ensure stable rotation, as shown in FIG. 4. In dynamics, the three blade sets 20 designate equivalent total mass and are balanceable with respect to an axis of the central hub 11 of the fan 1 during rotating.

Figure 5:
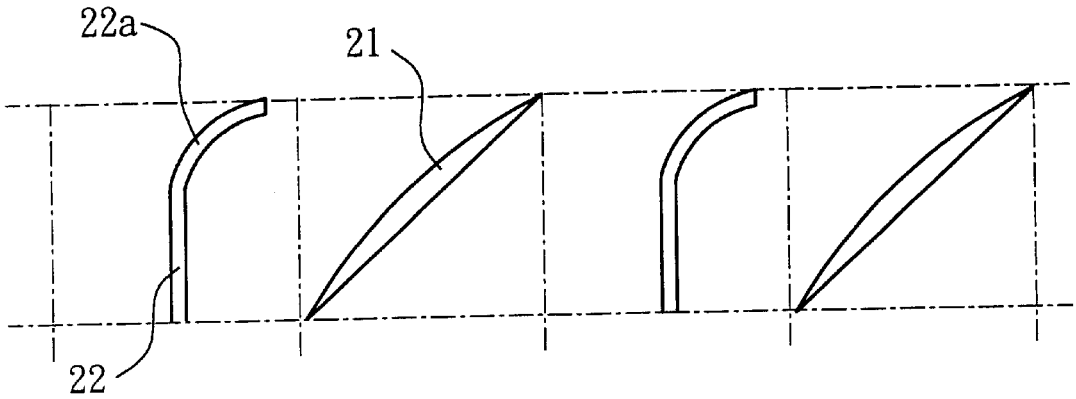
FIG. 5 is a schematic view representation of arranging blades in series of the blade set in accordance with the first embodiment of the present invention.

Construction of the blade set 20 shall be described in detail, referring now to FIGS. 4 and 5. Each blade set 20 is comprised of various blade designs to enhance blowing efficiency. The blade set 20 comprises two axial blades 21 and tow blower blades 22 which are arranged axial blade by blower blade, by turns and equally maintained in spaced relationship with one another, as shown in FIG. 5. Moreover, the blower blade 22 further designates a skewed portion 22*a* on its top and an extended portion 22*b* on its outer end that enhances blowing efficiency.

Figure 6:
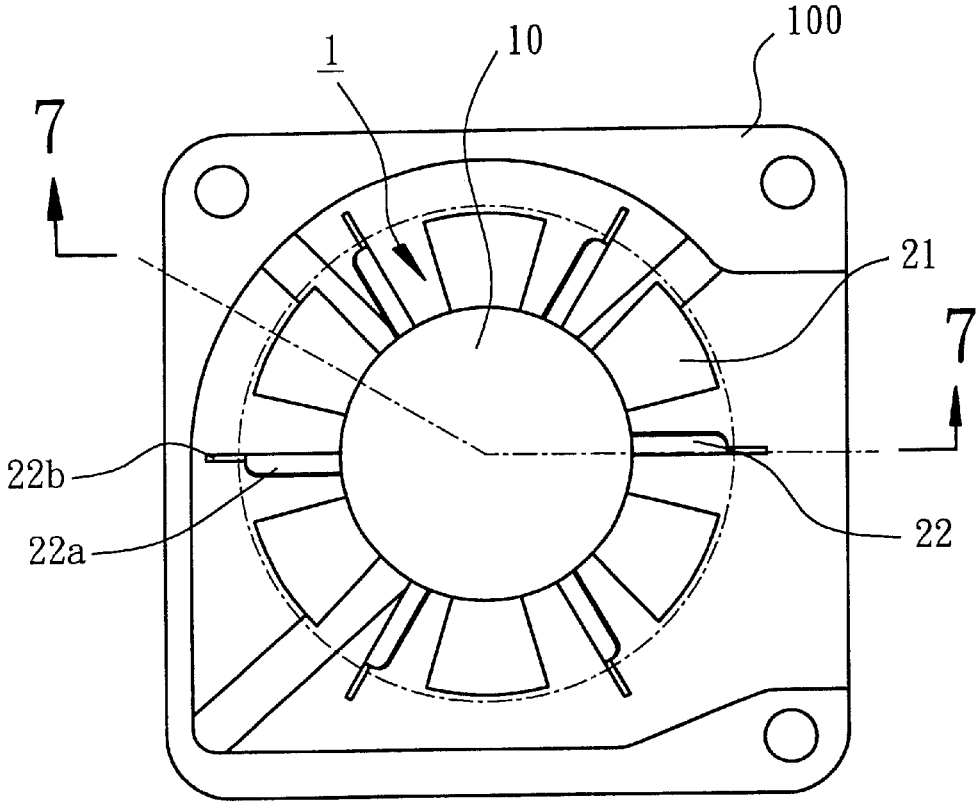
FIG. 6 is a top view of the fan assembling in a fan housing in accordance with the first embodiment of the present invention.
Figure 7:
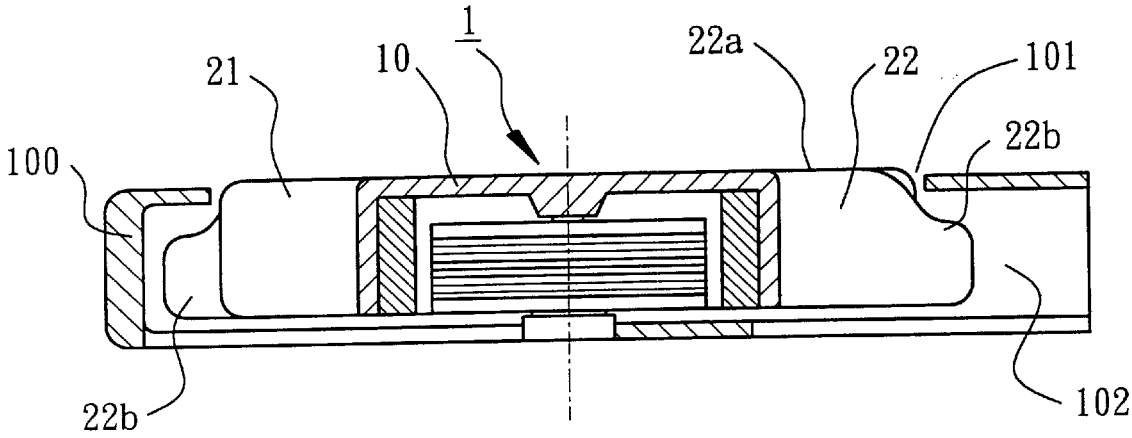
FIG. 7 is a cross-sectional view, taken along 7—7 in FIG. 6, of the fan in accordance with the first embodiment of the present invention.

Assembling the fan 1 in fan housing shall now be described with reference to FIGS. 6 and 7. As the fan 1 is rotatably mounted in an interior of a fan housing 100, the skewed portion 22*a* is aligned with an air inlet 101, as shown in FIG. 7. Meanwhile, the extended portion 22*b* is extended into a gap (not labeled) to enhance airflow blowing through an air outlet 102.

Figure 8:
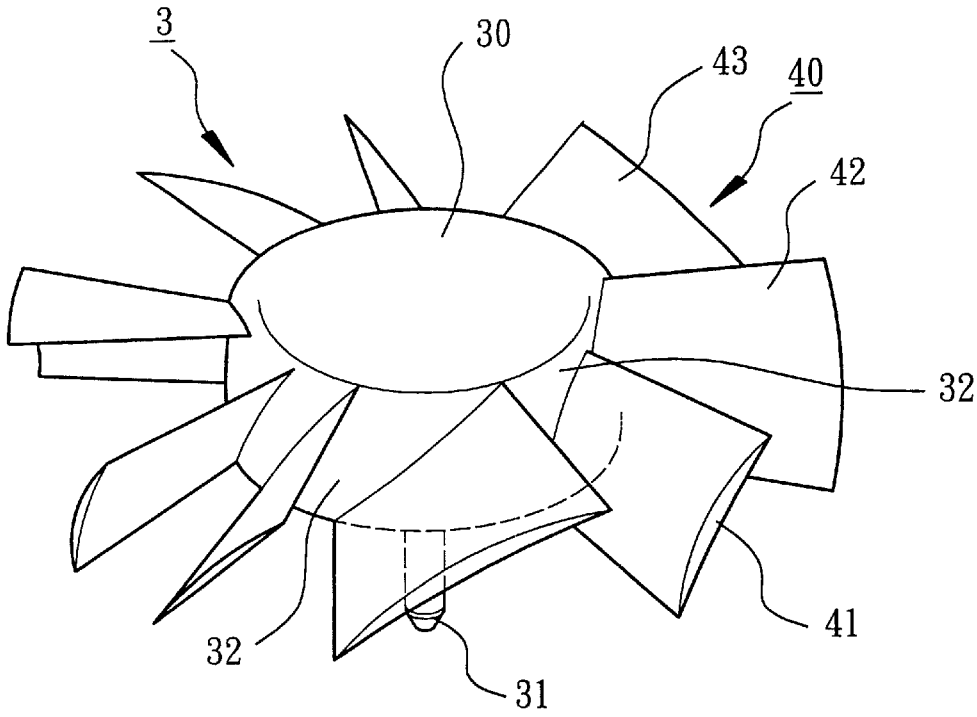
FIG. 8 is a perspective view of a fan in accordance with a second embodiment of the present invention.
Figure 9:
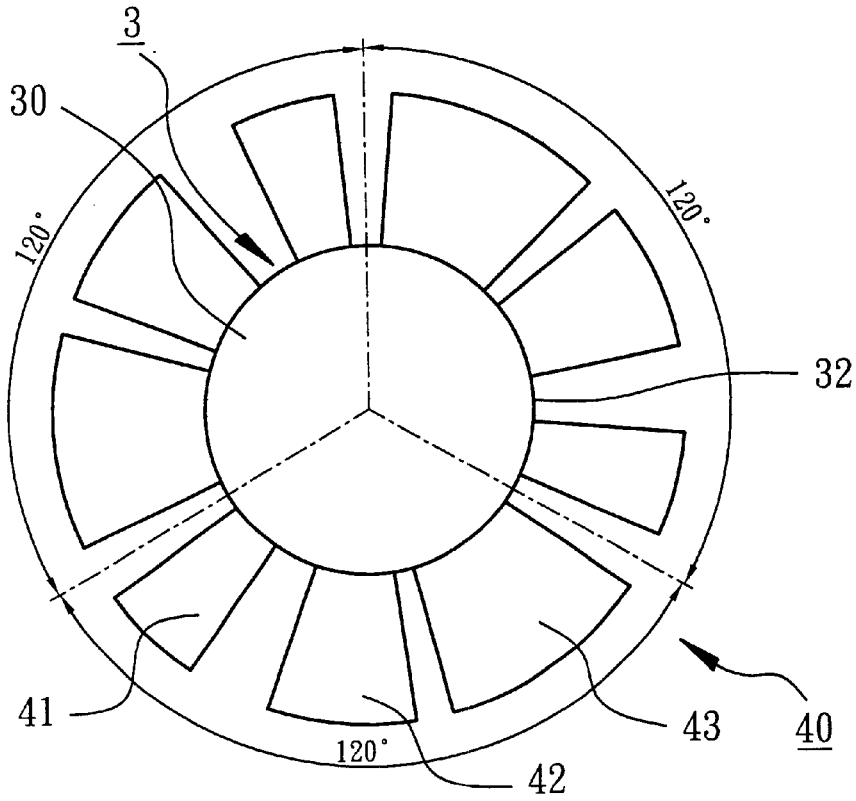
FIG. 9 is a top view of the fan in accordance with the second embodiment of the present invention.
Figure 10:
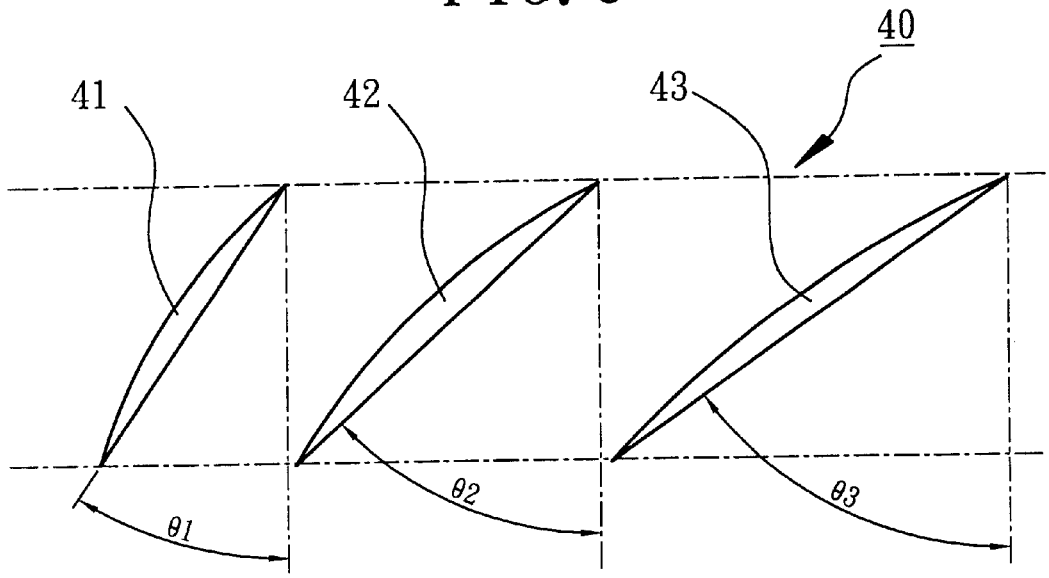
FIG. 10 is a schematic view representation of arranging blades in series of the blade set in accordance with the second embodiment of the present invention.

Referring to FIGS. 8 through 10, a fan designated as numeral 3 having balancing blade sets in accordance with the second embodiment of the present invention generally includes a central hub designated as numeral 30, a shaft designated as numeral 31 and a plurality of blade sets designated as numeral 40. The shaft 31 is axially extended from the central hub 30 to be received in a bearing (not shown) to rotate as a rotor of a motor. The preferred amount of the blades sets 40 is three and the sets are arranged to circle around an axis of the central hub 30 on a common plane. The blade sets 40 are radially extended from an outer circumference 32 of the central hub 30 and each blade set 40 is uniformly formed within an angular length of 120° to ensure stable rotation, as shown in FIG. 9. In dynamics, the three blade sets 40 have equivalent total mass and also are balanced with respect to an axis of the central hub 31 of the fan 3 during rotating.

Construction of the blade set 40 shall be described in detail, referring now to FIGS. 9 and 10. Each blade set 40 comprises a first skewed blade 41, a second skewed blade 42 and a third skewed blade 43 which are arranged by turns and equally maintained in spaced relationship one another, as shown in FIG. 10. The skewed blades 41, 42 and 43 have various angles $\theta_1$, $\theta_2$ and $\theta_3$ respectively on the outer circumference 32 of the fan 3 that changes the successively blowing directions with respect to the axis of the fan 3 during rotating. Accordingly, the skewed blades 41, 42 and 43 accommodate moving airflow in spiral along the axis of the fan 3 that enhances blowing efficiency.

Figure 11:
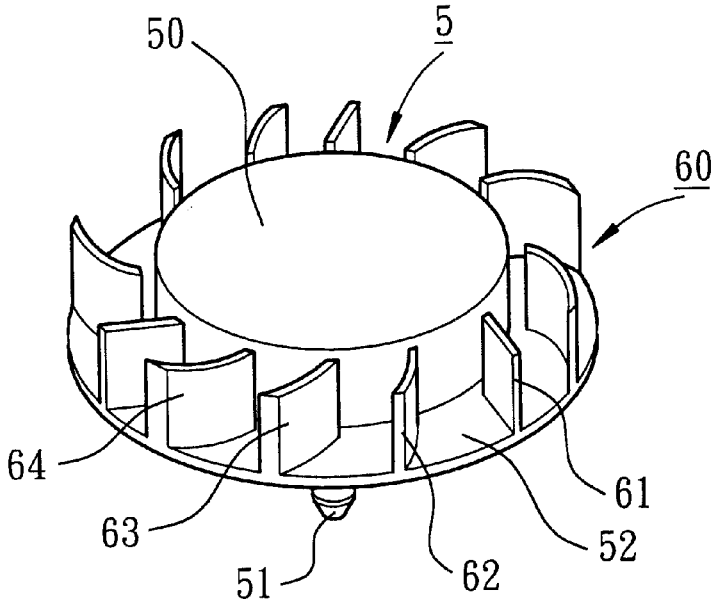
FIG. 11 is a perspective view of a fan in accordance with a third embodiment of the present invention.
Figure 12:
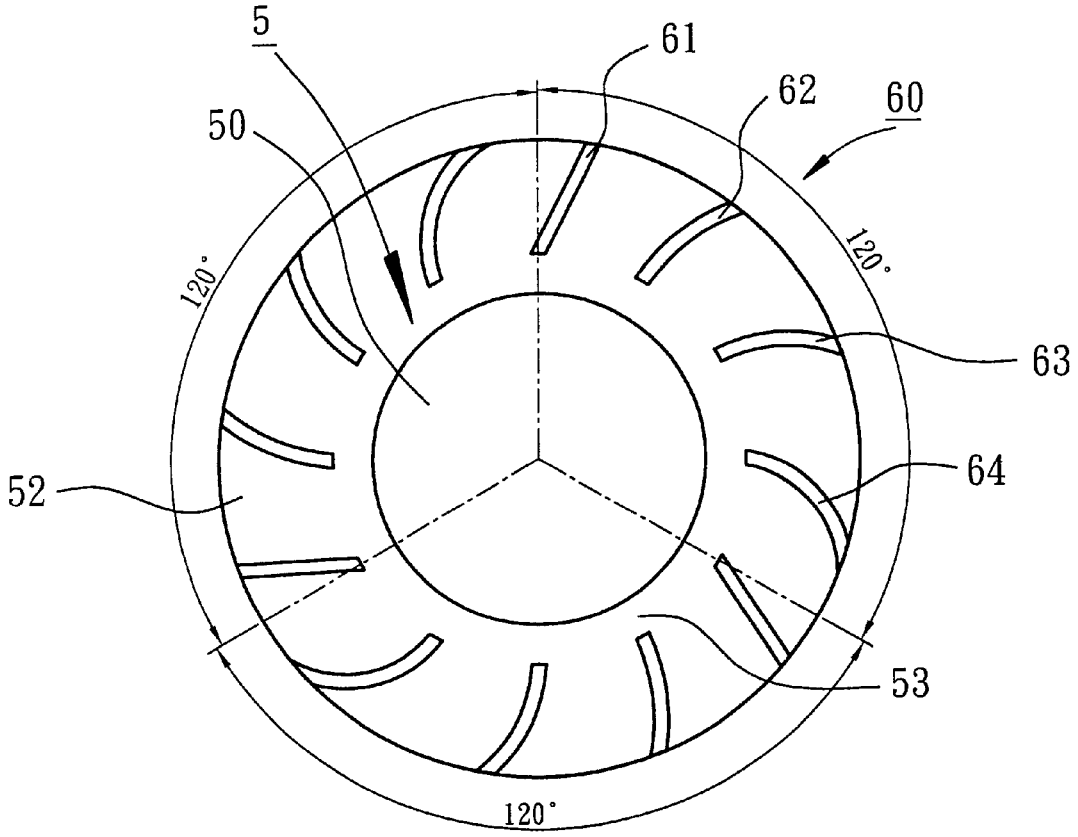
FIG. 12 is a top view of the fan in accordance with the third embodiment of the present invention.

Referring to FIGS. 11 and 12, a fan designated as numeral 5 having balancing blade sets in accordance with the third embodiment of the present invention generally includes a central hub designated as numeral 50, a shaft designated as numeral 51, an annular flange 52 and plurality of blade sets designated as numeral 60. The shaft 51 is axially extended from the central hub 50 to be received in a bearing (not shown) to rotate as a rotor of the motor. The annular flange 52 is projected upwardly from an outer end edge of the central hub 50 to form a singular member. The blade sets 60 are structurally attached to the annular flange 52 and divide the annular flange 52 into a plurality of zones (dotted line). The preferred amount of the blade sets is three and the sets are arranged to circle around an axis of the central hub 50 on a common plane. The blade sets 60 are radially extended proximate from an outer circumference of the central hub 50 and each blade set 60 is uniformly formed within an angular length of 120° to ensure stable rotation, as shown in FIG. 12. In dynamics, the three blade sets 60 designate equivalent total mass and also are balanced with respect to an axis of the central hub 51 of the fan 5 during rotating.

Construction of the blade set 60 shall be described in detail, referring now to FIGS. 11 and 12. Each blade set 60 comprises a blower blade 61, a first curved blower blade 62, a second curved blower blade 62 and a third curved blower blade 64 which are arranged in series and equally maintained in spaced relationship one another, as shown in FIG. 12. Between the central hub 50 and the curved blower blades 62, 63 and 64 defines an annular channel 53 to which to communicate with an air inlet (not shown). The curved blower blades 62, 63 and 64 have various curvatures with respect to the annular channel 53 of the fan 5 that moves inlet airflow in spiral with respect to the axis of the fan 5. Accordingly, the curved blower blades 62, 63 and 64 accommodate moving inlet airflow in spiral along the axis of the fan 5 that enhances outlet blowing efficiency and also reduces noise in a housing (not shown).

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A fan having balancing blade sets, including:

a central hub;

a shaft axially extending from the central hub; and at least three blade sets radially extended from an outer circumference of the central hub and being adapted to fit within an appropriate angular length, thereby ensuring stable rotation, wherein the blade set comprises at least one axial blade and one blower blade, and wherein the blower blade further comprises a skewed portion on its top and an extended portion on its outer end.

2. The fan having balancing blade sets as defined in claim 1, wherein the three blade sets are equi-spaced and each respective one of the blade sets is uniformly arranged within an angular length of 120°.

3. A fan having balancing blade sets, including a central hub;

a shaft axially extending from the central hub; and at least three blade sets radially extended from an outer circumference of the central hub and being adapted to fit within an appropriate angular length, thereby ensuring stable rotation, wherein each respective one of said blade sets comprises at least two skewed blades having various angles with respect to an axis of the fan.

4. A fan having balancing blade sets, including a central hub;

a shaft axially extending from the central hub; and at least three blade sets radially extended from an outer circumference of the central hub and being adapted to fit within an appropriate angular length, thereby ensuring stable rotation, wherein each respective one of said blade sets includes a plurality of curved blower blades attached to an annular flange of the central hub.

5. The fan having balancing blade sets as defined in claim 4, wherein the curved blower blades have various curvatures with respect to an axis of the fan to move inlet airflow in spirals with respect to the axis of the fan to thereby reduce noise in a housing.

* * * * *